US012458113B2

(12) United States Patent
Verstraete et al.

(10) Patent No.: US 12,458,113 B2
(45) Date of Patent: Nov. 4, 2025

(54) FASTENER TAPE

(71) Applicant: Velcro IP Holdings LLC, Manchester, NH (US)

(72) Inventors: Jonathan Verstraete, Lendelede (BE); Johan Marie Albert Lecluyse, Deurle (BE); Terry Bernard Jacques Raepsaet, Harelbeke (BE)

(73) Assignee: Velcro IP Holdings LLC, Manchester, NH (US)

( * ) Notice: Subject to any disclaimer, the term of this patent is extended or adjusted under 35 U.S.C. 154(b) by 509 days.

(21) Appl. No.: 17/336,579

(22) Filed: Jun. 2, 2021

(65) Prior Publication Data

US 2021/0282508 A1 Sep. 16, 2021

Related U.S. Application Data

(63) Continuation of application No. 16/423,241, filed on May 28, 2019, now abandoned, which is a (Continued)

(51) Int. Cl.
*A44B 18/00* (2006.01)

(52) U.S. Cl.
CPC ..... *A44B 18/003* (2013.01); *A44B 18/0042* (2013.01); *A44B 18/0049* (2013.01); *A44B 18/0069* (2013.01); *A44B 18/0073* (2013.01)

(58) Field of Classification Search
CPC ..... A44B 18/0073; A44B 18/0069; A44B 18/0049; A44B 18/0042; A44B 18/003
See application file for complete search history.

(56) References Cited

U.S. PATENT DOCUMENTS 2,820,277 A 1/1958 Karl
3,138,841 A * 6/1964 Naimer ..... D06C 29/00 264/157

(Continued)

FOREIGN PATENT DOCUMENTS

CA 1005621 2/1977
CN 1138839 12/1996

(Continued)

OTHER PUBLICATIONS

CN Notification of the Decision to Grant a Patent in Chinese Appln. No. 201780045982.8, dated Mar. 9, 2022, 5 pages (with English translation).

(Continued)

*Primary Examiner* — Jason W San
(74) *Attorney, Agent, or Firm* — Fish & Richardson P.C.

(57) ABSTRACT

A self-engaging fastener has a flexible base sheet and an array of discrete fastener elements projecting from a broad side of the base sheet. Each fastener element has a stem extending from the base sheet and a head at a distal end of the stem, the head overhanging the base sheet on multiple sides of the stem. The heads of the discrete fastener elements are arranged in a pattern of hexagonal groupings of fastener element heads bordering central regions void of fastener element heads, with each fastener element head spaced from edges of the array being part of three adjacent groupings. The product features a particularly high separation resistance for the area of the product covered by the heads.

19 Claims, 8 Drawing Sheets

Related U.S. Application Data continuation of application No. 15/201,820, filed on Jul. 5, 2016, now Pat. No. 10,349,707.

(56) References Cited

U.S. PATENT DOCUMENTS 3,191,255 A 6/1965 Raymond
3,192,589 A 7/1965 Pearson
3,261,069 A 7/1966 Mathison
3,266,113 A * 8/1966 Flanagan, Jr. ..... A44B 18/0053 24/452
3,312,583 A 4/1967 Rochlis
3,320,649 A * 5/1967 Naimer ..... D03D 27/06 28/165
3,399,425 A 9/1968 Lemelson
3,408,705 A * 11/1968 Kayser ..... A44B 18/0065 24/446
3,469,289 A * 9/1969 Whitacre ..... A44B 18/0003 24/442
3,527,001 A 9/1970 Kleemeier et al.
3,557,407 A 1/1971 Lemelson
3,718,725 A 2/1973 Hamano
3,808,648 A 5/1974 Billarant et al.
4,169,303 A 10/1979 Lemelson
4,290,174 A 9/1981 Kalleberg
4,338,800 A * 7/1982 Matsuda ..... D04B 35/34 66/196
4,454,183 A * 6/1984 Wollman ..... A44B 18/0042 428/92
4,770,917 A * 9/1988 Tochacek ..... B32B 5/02 442/388
4,775,310 A 10/1988 Fischer
4,794,028 A 12/1988 Fischer
4,880,589 A 11/1989 Shigemoto et al.
5,076,793 A 12/1991 Aghevli et al.
5,077,870 A 1/1992 Melbye et al.
5,242,646 A 9/1993 Torigoe et al.
5,396,687 A 3/1995 Osterman
5,457,855 A 10/1995 Kenney et al.
5,607,635 A 3/1997 Melbye et al.
5,625,929 A * 5/1997 Hattori ..... A44B 18/0053 24/452
5,657,516 A 8/1997 Berg et al.
5,679,302 A 10/1997 Miller et al.
5,685,050 A 11/1997 Murasaki
5,691,021 A * 11/1997 Kobe ..... A44B 18/0092 428/354
5,692,271 A * 12/1997 Provost ..... A44B 18/0088 24/442
5,713,111 A * 2/1998 Hattori ..... A44B 18/0053 264/173.1
5,725,015 A 3/1998 Theodos et al.
5,749,129 A 5/1998 Murasaki et al.
5,755,015 A 5/1998 Akeno et al.
5,781,969 A 7/1998 Akeno et al.
5,792,408 A 8/1998 Akeno et al.
5,845,375 A 12/1998 Miller et al.
5,852,855 A * 12/1998 Mody ..... A61F 13/625 24/445
5,868,987 A 2/1999 Kampfer et al.
5,879,604 A 3/1999 Melbye et al.
5,880,845 A 3/1999 Leroux
5,933,927 A 8/1999 Miller et al.
5,951,931 A 9/1999 Murasaki et al.
5,953,797 A * 9/1999 Provost ..... B29C 43/222 24/304
5,981,027 A 11/1999 Parellada
6,000,106 A 12/1999 Kampfer et al.
6,039,911 A 3/2000 Miller et al.
6,054,091 A 4/2000 Miller et al.
6,162,040 A 12/2000 Clune
6,248,276 B1 6/2001 Parellada et al.
6,254,304 B1 * 7/2001 Takizawa ..... A44B 18/0073 24/444
6,287,665 B1 9/2001 Hammer
6,357,088 B2 3/2002 Provost et al.
6,475,593 B1 11/2002 Hattori et al.
6,526,633 B2 3/2003 Provost et al.
6,627,133 B1 9/2003 Tuma
6,678,924 B2 1/2004 Murasaki et al.
6,687,962 B2 * 2/2004 Clarner ..... A44B 18/0065 24/442
6,911,843 B2 6/2005 Mizumoto et al.
8,776,331 B2 * 7/2014 Poulakis ..... A44B 18/0053 24/445
10,126,832 B2 * 11/2018 Noorzai ..... G06F 3/0231
10,349,707 B2 7/2019 Verstraete et al.
11,246,380 B2 * 2/2022 Parellada Armela ... B29C 67/08
2001/0018110 A1 8/2001 Tuman et al.
2002/0069495 A1 6/2002 Murasaki
2002/0114909 A1 * 8/2002 Aiello ..... C09J 7/22 428/40.1
2003/0074771 A1 * 4/2003 Duffy ..... A44B 18/0053 24/442
2003/0085492 A1 5/2003 Schulte
2003/0106189 A1 * 6/2003 Okawa ..... A44B 18/0069 24/442
2003/0131453 A1 7/2003 Clarner et al.
2003/0135964 A1 7/2003 Provost et al.
2004/0172793 A1 * 9/2004 Gallant ..... A47G 27/0412 24/451
2005/0081345 A1 * 4/2005 Tolan ..... A44B 18/0061 24/452
2006/0200951 A1 * 9/2006 Provost ..... A44B 18/0061 24/452
2008/0018025 A1 * 1/2008 Duffy ..... A44B 18/0073 264/503
2009/0208698 A1 * 8/2009 Langen ..... A61F 13/622 428/100
2010/0136281 A1 * 6/2010 Sitti ..... A44B 18/0049 428/92
2013/0000085 A1 * 1/2013 Cina ..... A44B 18/0065 83/13
2013/0059111 A1 3/2013 Idrizovic et al.
2013/0067702 A1 * 3/2013 Tuma ..... A44B 18/0049 24/450
2014/0137377 A1 * 5/2014 Cheng ..... B29C 43/46 24/449
2014/0322480 A1 * 10/2014 Koehler ..... A44B 17/0058 264/319
2014/0349079 A1 * 11/2014 Chandrasekaran ... A61F 13/625 24/442
2015/0275941 A1 * 10/2015 Nisogi ..... A44B 18/0065 403/364
2015/0361599 A1 * 12/2015 Minor ..... D03D 13/008 139/420 R
2016/0366991 A1 * 12/2016 Mascarenhas ..... B29C 44/1271
2018/0008010 A1 1/2018 Verstraete et al.
2018/0116346 A1 * 5/2018 Hertlein ..... A61F 13/625
2019/0274396 A1 9/2019 Verstraete

FOREIGN PATENT DOCUMENTS

CN 1541073 10/2004
CN 1617682 5/2005
CN 1897841 1/2007
CN 102421319 4/2012
CN 104320990 1/2015
DE 2213686 5/1972
DE 29608260 1/1996
DE 19828856 7/1999
DE 10056567 5/2002
DE 102007012656 9/2008
EP 0811332 10/1997
EP 0806158 12/1997
EP 2164356 3/2010
EP 2547607 1/2013
GB 2115481 9/1983
GB 2279106 12/1994
GB 2349354 1/2000
JP H0759607 3/1995

(56) References Cited

FOREIGN PATENT DOCUMENTS

| | | |
|---|---|---|
| JP | H09173111 | 7/1997 |
| KR | 20150019231 | 2/2015 |
| KR | 20160011387 | 2/2016 |
| WO | WO 1982/002480 | 5/1982 |
| WO | WO 1992/004839 | 2/1992 |
| WO | WO 1994/023610 | 10/1994 |
| WO | WO 1995/022918 | 8/1995 |
| WO | WO 1995/003723 | 9/1995 |
| WO | WO 1998/030381 | 7/1998 |
| WO | WO 1998/014086 | 9/1998 |
| WO | WO 1998/057564 | 12/1998 |
| WO | WO 1998/057565 | 12/1998 |
| WO | WO 1999/026507 | 3/1999 |
| WO | WO 1999/010161 | 4/1999 |
| WO | WO 2000/000053 | 6/2000 |
| WO | WO 2000/041479 | 7/2000 |
| WO | WO 2001/024654 | 12/2001 |
| WO | WO 2009/006614 | 1/2009 |
| WO | WO 2011/100999 | 8/2011 |

OTHER PUBLICATIONS

CN Office Action in Chinese Appln. No. 201780045982.8, dated Dec. 29, 2021, 16 pages (with English Translation).

Manwatkar et al., "Fracture Analysis of High Strength Steel Fastener Used in Separation System of a Satellite Launch Vehicle," Practical Metallography, Feb. 2016, 53(3), abstract only, retrieved from URL <https://www.degruyter.com/document/doi/10.3139/147.110353/html>, 4 pages.

EP Office Action in European Appln. No. 17735111.1, dated Sep. 27, 2021, 6 pages.

"Velcro Fastener Applications Publications," Velcro International Limited, received Nov. 23, 2004, 8 pages.

3M TM Loop Fastener SJ3571, Apr. 2014 (Year: 2014).

ADM ET, Apr. 8, 2016 (Year: 2016).

ASTM D5169, 2015 (Year: 2015).

ASTM D5170, 2015 (Year: 2015).

CN Office Action in Chinese Appln. No. 201780045982.8, dated Mar. 16, 2021, 27 pages (with English Translation).

EP Office Action in European Appln. No. 17735111.1, dated Aug. 28, 2020, 5 pages.

EP Office Action in European Appln. No. 17735111.1, dated Jul. 23, 2020, 3 pages.

EP Office Action in European Appln. No. 17735111.1, dated Mar. 12, 2021, 5 pages.

International Search Report and Written Opinion in International Application No. PCT/EP2017/066535, dated Aug. 30, 2017, 14 pages.

* cited by examiner

FASTENER TAPE

CROSS-REFERENCE TO RELATED APPLICATIONS

This application is a continuation of U.S. Ser. No. 16/423,241, filed on May 28, 2019, which is a continuation of U.S. Ser. No. 15/201,820, filed on Jul. 15, 2016, now issued U.S. Pat. No. 10,349,707. The disclosure of the prior applications are hereby incorporated by reference in their entirety and are therefore considered part of the disclosure of this application.

TECHNICAL FIELD

This invention relates to fasteners, and more particularly to fastener tapes of the self-engaging type, and to methods of their manufacture.

BACKGROUND

Self-engaging fastener tapes have arrays of a large number of projections that can interlock when two lengths of such tape are mated together. Usually the projections have enlarged heads supported on stems that rise from a flexible base. Projections with heads that overhang the stems in essentially all directions are sometimes referred to as 'mushroom-type' projections. When the tapes engage, the heads of each tape 'snap' past the heads of the other tape, often resulting in a tactile confirmation of engagement. Self-engaging fastener tapes have been made by weaving processes, as well as by plastics molding processes. Self-engaging fastener products are particularly useful for joining two rigid surfaces, where the primary mode of separation would be by lifting force (i.e., a force applied perpendicular to the interface between the two surfaces), rather than by a peeling motion.

Improvements are sought in the performance and value of fasteners, especially in self-engaging fastener tapes, and in the processes for making them.

SUMMARY

Various aspects of the invention feature a fastener with a flexible base sheet and an array of discrete fastener elements projecting from a broad side of the base sheet. Each fastener element has a stem extending from the base sheet and a head at a distal end of the stem, the head overhanging the base sheet on multiple sides of the stem.

According to one aspect of the invention, the heads of the discrete fastener elements are arranged in a pattern of hexagonal groupings of fastener element heads bordering central regions void of fastener element heads, with each fastener element head spaced from edges of the array being part of three adjacent groupings.

In some cases, the stems of the fastener elements have a non-circular cross-section. For example, the cross-section of each stem may define four legs extending from a central hub.

In some examples, each head has multiple lobes (e.g., four) extending in different directions. The number of lobes may correspond, for example, to a number of longitudinal flanges or protrusions of the stem. Preferably, the lobes extend toward the broad side of the base sheet to define, with an underside of the fastener element head, respective crooks or snagging features. In some cases the stem has longitudinal flanges and the lobes align with spaces between the flanges of the stem.

In some embodiments, each grouping of fastener element heads consists of six heads.

Preferably, the fastener has a Head Coverage (as defined below) of between 30 and 60 percent (more preferably, between 45 and 55 percent).

In some configurations the stems of the fastener elements are canted in different directions and/or the heads have free-form, domed upper surfaces.

In some cases, the stems are molded integrally with the broad side of the base sheet.

In some examples, the base sheet is or includes a woven base, and the stems of the fastener elements are extensions of fibers woven into the base. The stems, for example, may be extensions of monofilament fibers that may be warp fibers of the woven base. In some cases, the monofilament fibers are drawn monofilament fibers of non-circular cross-section.

In some embodiments the stems are arranged in pairs, with each pair consisting of two ends of a single, continuous fiber woven into the base (such as two ends of a segment of warp fiber). In some cases, the single, continuous fiber extends about only a single set of one or more fibers woven as a set through the woven base (such as a set of weft fibers).

In some configurations, the woven base has longitudinal selvedges void of fastener element stems.

For some applications, the fastener may also have a coating covering a side of the woven base opposite the fastener elements and binding fibers of the woven base. The fastener may also have an adhesive (such as a pressure-sensitive adhesive) bonded to the coating and operable to secure the fastener product to a substrate.

Such a product is preferably configured for self-engagement. Another aspect of the invention features two regions of such product, such as two regions of a single product, or two separate products, overlapped to engage their respective fastener elements to releasably engage the two regions to form a fastening.

Another aspect of the invention features a fastener with a flexible base sheet and an array of discrete fastener elements projecting from a broad side of the base sheet (each fastener element comprising a stem extending from the base sheet and a head at a distal end of the stem, the head overhanging the base sheet on multiple sides of the stem) in which the ratio of Self-Engaged Lift Resistance to Head Coverage (both as defined below) is greater than 45 N/cm$^2$ (preferably greater than 60, or even greater than 75, or between 45 and 200, between 60 and 120, or between 75 and 110 N/cm$^2$).

In a preferred configuration, the stems of the fastener elements are of non-circular cross-section and each head has multiple lobes extending in different directions.

Preferably, the Head Coverage is between 30 and 60 percent (more preferably between 45 and 55 percent).

In some cases, the stems of the fastener elements are canted in different directions.

The base sheet may be in the form of, or include, a woven base, and the stems of the fastener elements being extensions of fibers woven into the base. The woven base may include longitudinal selvedges void of fastener element stems.

As with the product described earlier, such a product is preferably configured for self-engagement. Another aspect of the invention features two regions of such product, such as two regions of a single product, or two separate products, overlapped to engage their respective fastener elements to releasably engage the two regions to form a fastening.

Another aspect of the invention features a method of making a fastener product. The method includes weaving longitudinally continuous warp fibers with weft fibers to form a woven fabric (the longitudinally continuous warp fibers including base warp fibers and monofilament warp fibers woven to extend from the base), severing the monofilament warp fibers at a distance from the base to form severed ends with engageable heads, applying a molten coating to a side of the woven fabric opposite the engageable heads so as to bind at least the monofilament warp fibers to the weft fibers, and while the molten coating remains tacky, bonding a pressure-sensitive adhesive to the coating.

The method may also include at least partially annealing the monofilament warp fibers after weaving and before severing, such as to set an orientation of the woven monofilament fibers.

In some examples the weaving produces a double-layer fabric, each layer of the fabric comprising respect weft fibers and base warp fibers, with the monofilament warp fibers woven to connect the two layers. In such cases the severing separates the fabric layers, thereby forming two separate lengths of fastener product.

Yet another aspect of the invention features a method of making a fastener product that includes weaving longitudinally continuous warp fibers with weft fibers to form a woven fabric (the longitudinally continuous warp fibers including base warp fibers and monofilament warp fibers woven to extend from the base), and then severing the monofilament warp fibers at a distance from the base to form severed ends with engageable heads arranged in a pattern of hexagonal groupings of heads bordering central regions void of heads, with each head spaced from edges of the pattern being part of three adjacent groupings.

In some examples the heads are comprised of pairs of heads formed from two ends of a single, continuous warp fiber segment. Preferably, the weaving is such that each single, continuous warp fiber segment corresponding to a pair of heads extends about only a single set of one or more of the weft fibers woven as a set through the fabric.

The fastener product produced according to these features and methods can be produced economically and configured to provide a relatively strong fastening performance in a self-engaging mode, particularly in resistance to lift forces-such as in fastenings between two rigid substrates. The arrangement of fastener elements heads can allow engageability in multiple orientations, with good lift resistance and relatively low force required for engagement, with a particularly high separation resistance for the area of the product covered by the heads.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
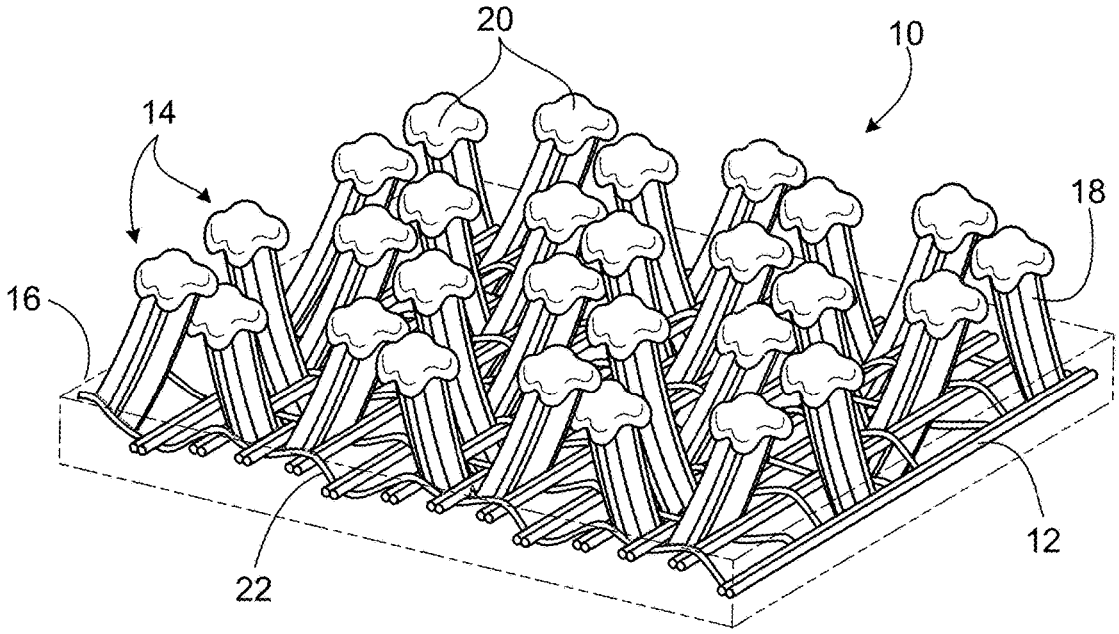
FIG. 1 is a perspective view of an upper surface of a woven fastener product.

Referring first to FIG. 1, touch fastener 10 has a flexible base sheet 12 and an array of discrete fastener elements 14 projecting from a broad side 16 of the base sheet. Each fastener element 14 has a stem 18 extending from the base sheet and a head 20 at a distal end of the stem. The head overhangs the base sheet on multiple sides of the stem. In this example, the base sheet (in this illustration, shown in dot-dash outline) includes a woven fabric ground 22 made up of warp and weft threads. Each fastener element 14 is an end of a polymer monofilament 24 woven into the ground as a warp thread. The product may have selvedges (not shown) void of fastener elements, and may be provided in the form of an elongated strip.

Figure 2:
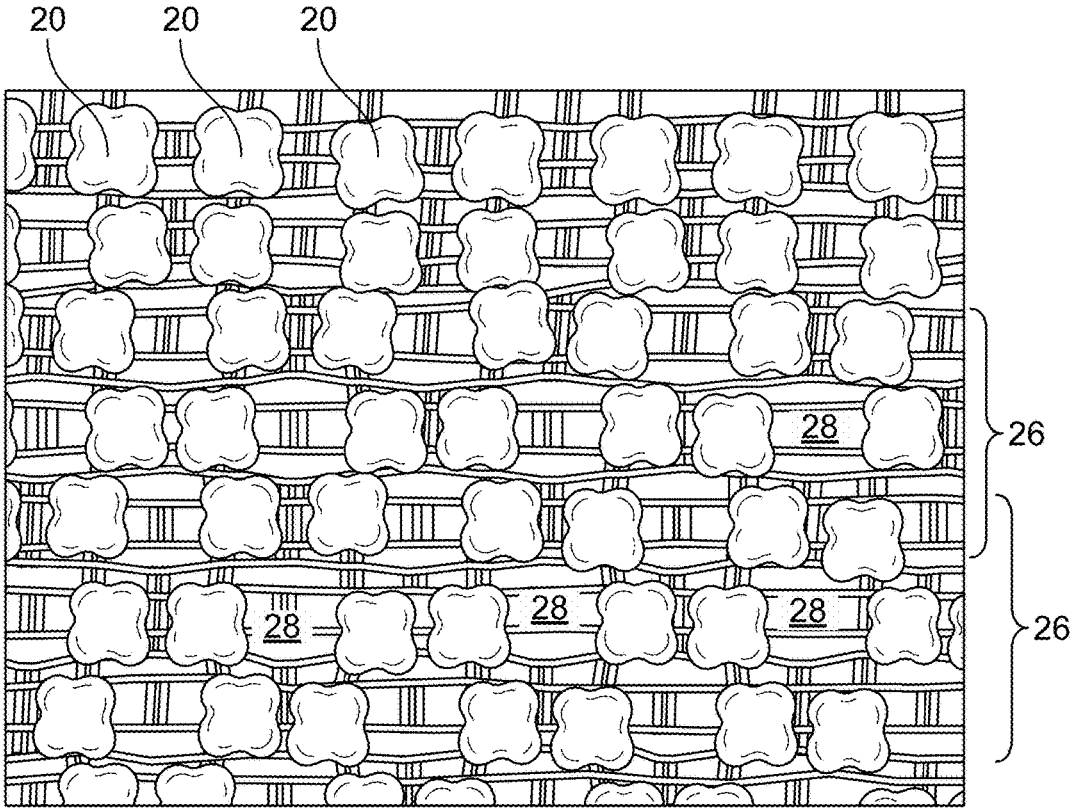
FIG. 2 is a top view photograph of a fastener product, showing the arrangement of fastener elements.
Figure 2A:
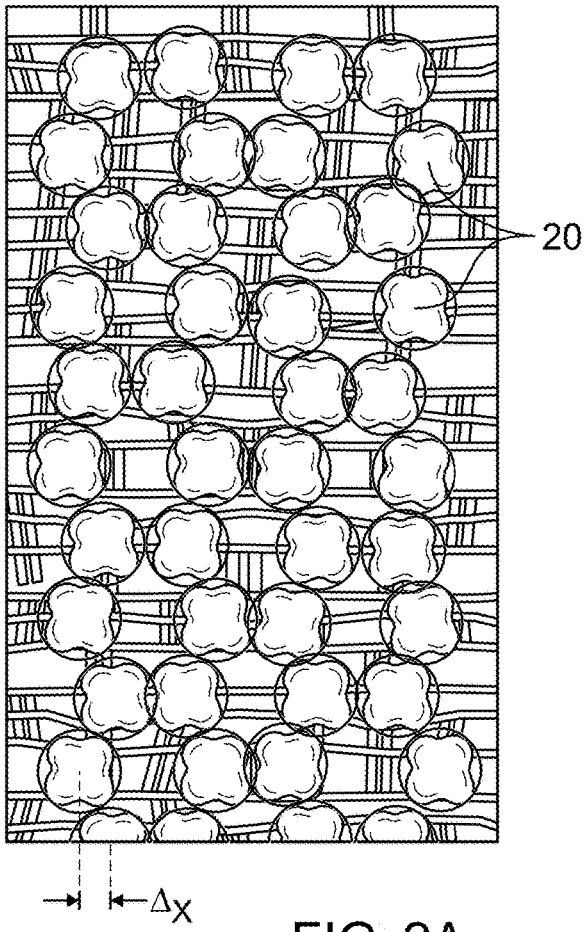
FIG. 2A is such a photo highlighted to indicate the locations of fastener element heads.
Figure 2B:
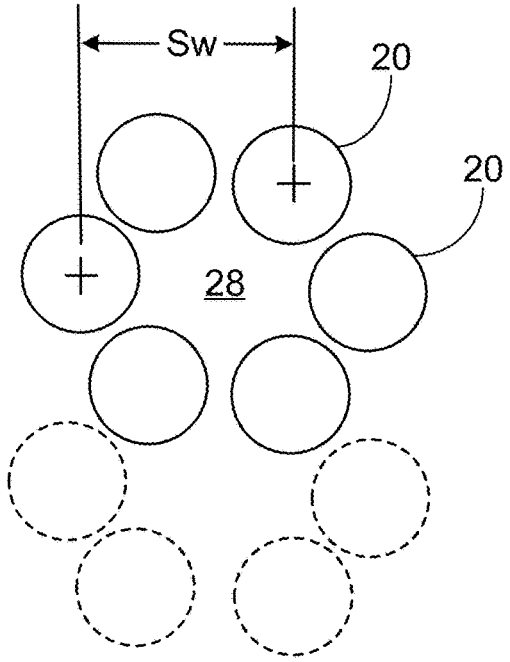
FIG. 2B illustrates one hexagonal grouping of fastener elements.

Referring to FIGS. 2 and 2A, the fastener element heads 20 are arranged in a pattern of hexagonal groupings 26 of fastener element heads bordering central regions 28 void of fastener element heads, with each fastener element head 20 spaced from edges of the array being part of three adjacent groupings 26. In this embodiment, each grouping 26 consists of six fastener element heads, with each head of the grouping being closer to two other heads of the grouping than to any other head of the grouping. As shown in these photographs, the hexagonal arrangement of each grouping is not mathematically precise, given the woven structure of the product and its method of formation. But the middle pair of fastener element heads of each grouping are displaced outwardly in the weft direction, in comparison with the leading and trailing pairs of the grouping (according to the warp direction), an amount sufficient to approximate a hexagonal arrangement. In this example, the weft displacement $\Delta x$ is approximately one half of the lateral width of a fastener element head. As illustrated in FIG. 2B, in which the solid line circles represent all of the heads of one hexagonal grouping and the dashed line circles represent four fastener element heads that, together with the closest two solid line heads, form an adjacent grouping, the spacing Sw between the first and third rows of fastener element heads of a grouping, as measured in the warp or longitudinal direction, is about 2.5 mm.

Figure 3:
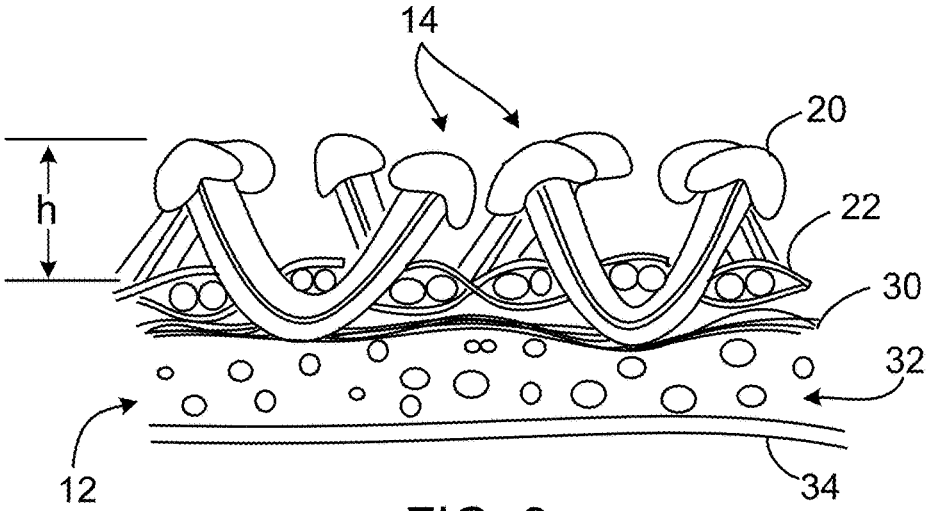
FIG. 3 is a schematic side view of a woven fastener product.
Figure 4:
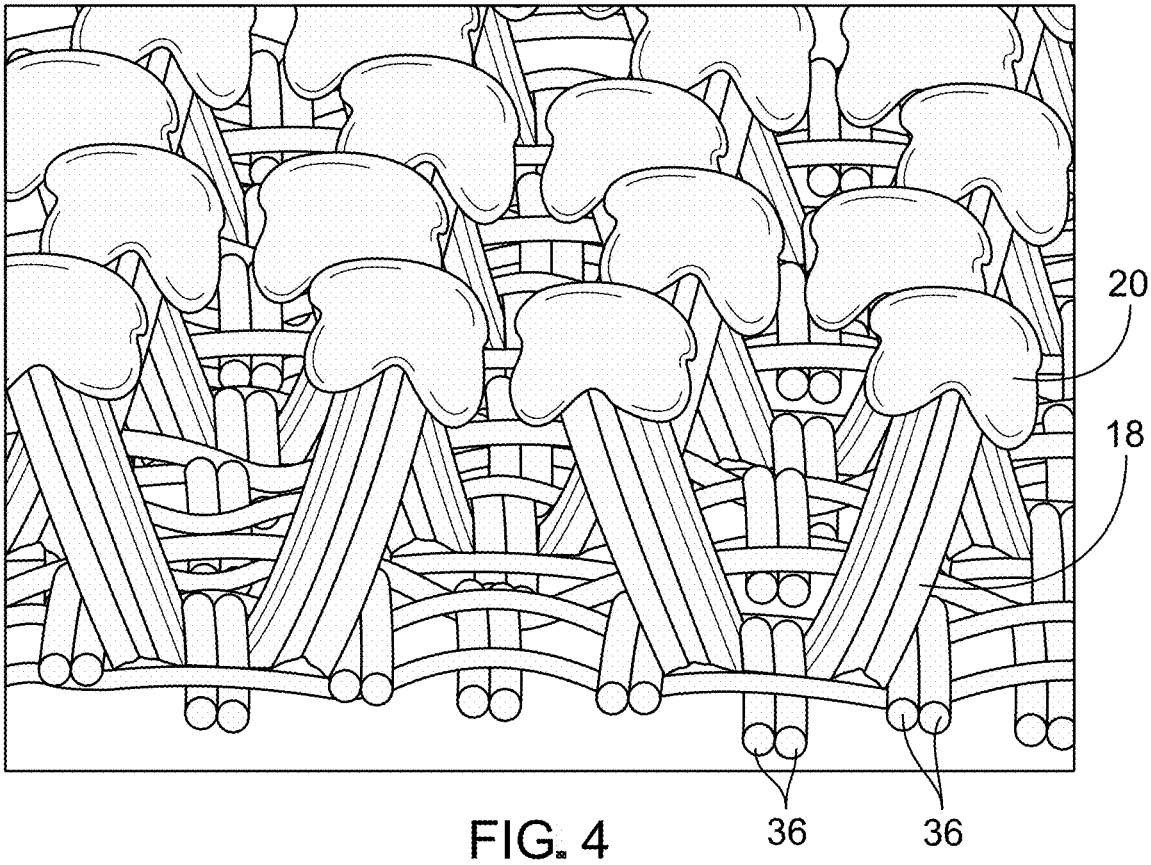
FIG. 4 is an edge perspective photograph of the fastener product of FIG. 2, taken in the weft direction.

Referring next to FIG. 3, the fastener elements 14 extend to a height 'h' of about 1.8 mm from the broad side 16 of base sheet 12. The opposite side of the fabric ground 22 carries a layer of binder 30 and a foam pressure-sensitive adhesive (PSA) 32 covered by a release liner 34, for securing the touch fastener to a supporting surface. As seen in the photograph of FIG. 4, the stems 18 of the fastener elements are angled, such that the upper end of each stem is displaced laterally from the lower end of the stem in the warp direction. There is a slight curvature to the stems, but in general they extend straight from the fabric ground to their respective heads. FIG. 4 also shows the general shape of the overhanging heads 20, which can be characterized as quadra-lobal with domed upper surfaces. FIG. 4 also illustrates how the canting or leaning of the stems relates to the resulting hexagonal arrangement of heads. The six heads closest to the center of the photograph form one hexagonal grouping 26.

Figure 5:
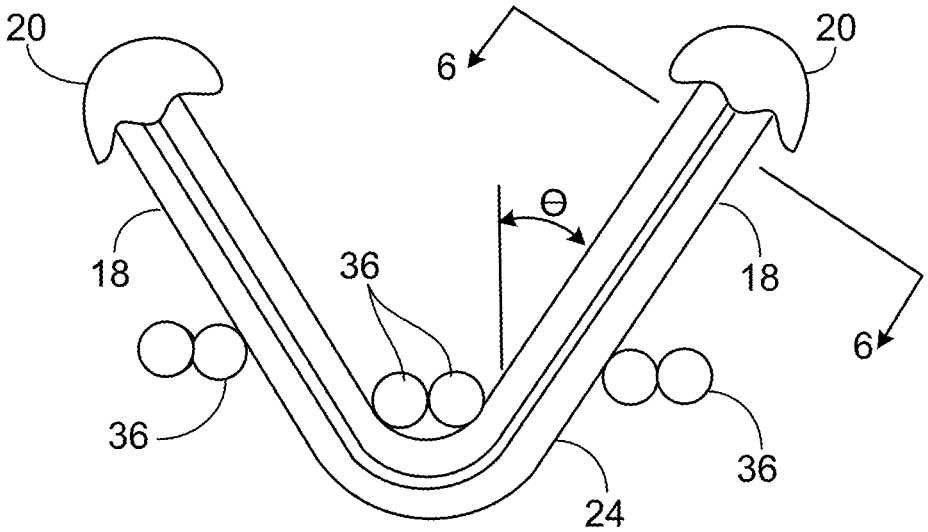
FIG. 5 is an enlarged illustration of a monofilament segment forming two fastener elements.

As illustrated in FIG. 5, each fastener element 14 is one of an adjacent pair of fastener elements formed as opposite ends of a segment of warp monofilament 25 woven into the ground such as by being bent around one set of weft yarns 36 and separating that set of weft yarns from adjacent sets of weft yarns. Each stem rises at an angle θ with respect to vertical. The head height H1, measured along the longitudinal axis of the stem, is about 0.6 mm including the lobes, and about 0.35 mm (H2) not including the lobes. The inclination of the stem is a function of the monofilament properties, weave characteristics and processing parameters, as will be discussed below. In this example, θ is between about 14 and 20 degrees and is sufficient, in combination with the weave spacing and fastener element length, to produce the desired hexagonal head pattern.

Figure 6:
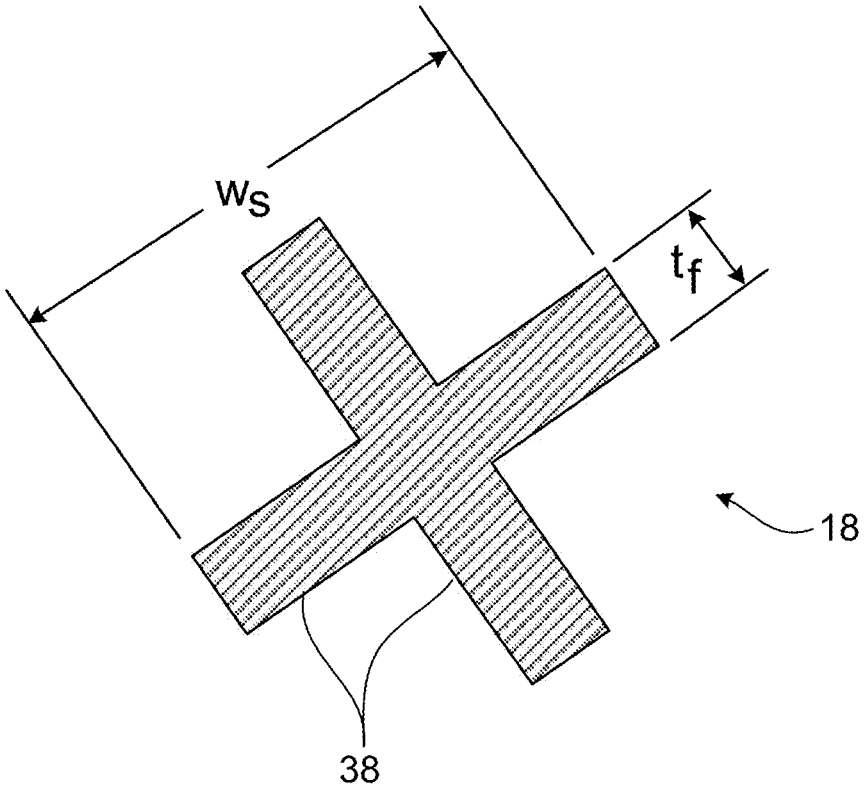
FIG. 6 is a cross-sectional view of a fastener element stem, taken along line 6-6 in FIG. 5.
Figure 7:
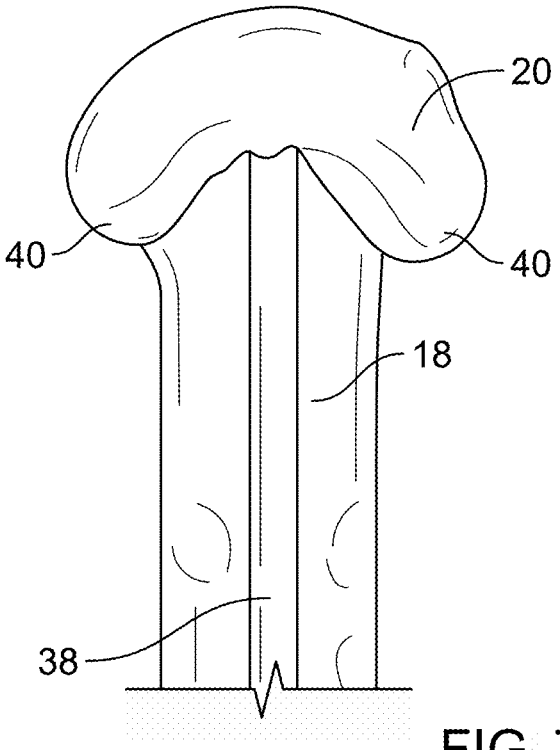
FIG. 7 is a side view of a fastener element, taken in the warp direction.

The stem monofilament is of polypropylene and has a cross-sectional shape that helps to effect the lobed configuration of the head. As shown in FIG. 6, the stem 18 has four equally spaced longitudinal flanges 38 extending from a central hub. Each flange has a thickness tf of about 0.1 mm, and the overall width ws of the stem, as measured between opposite flange ends, is about 0.5 mm. The cross-sectional area of the stem is such that the monofilament has a 1447 dTex, or the equivalent of a round section of 0.45 mm diameter. Such a monofilament is available from Monosuisse AG of Emmen, Switzerland, as part number STM2594. The head forms such that each lobe 40 forms between two flanges, as shown in FIG. 7.

Figure 8:
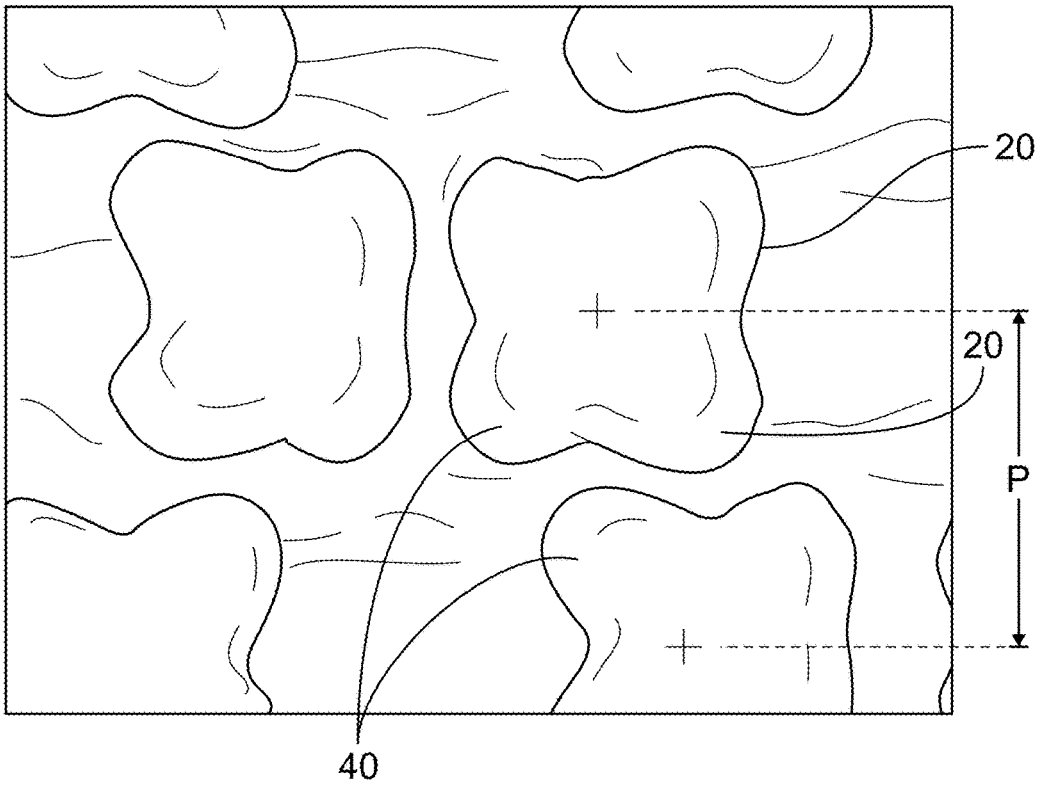
FIG. 8 is an enlarged top view of fastener element heads of the fastener product of FIG. 2.

Referring next to FIG. 8, each head 20 has a smooth upper surface and four generally equally spaced lobes 40. The size of the resulting head is such that the four lobes generally fit, in the plane of the product, within a 1.4 mm diameter circle. The planar area occupied by the head, measured within a plane parallel to the product base, is on average about 1.17 $mm^2$, ranging from about 1.1 to 1.2 $mm^2$. The pitch 'P' between warp monofilaments, measured in the weft direction, is about 2.5 mm. The Head Coverage of the product is generally the proportion of the area of the product covered by the heads, determined prior to any significant deterioration or alteration of the product through use. To calculate Head Coverage, a selected area of fastener product including at least 30 fastener elements formed from each of at least five warp filaments is viewed from above. The boundaries of the selected area are chosen such that the left/right and leading/trailing boundaries are at similar positions with respect to the pattern of fastener elements. The area of the projection of each fastener element head within the selected area is measured by tracing the visible edge of the fastener element head to form a closed polygon reasonably approximating the outline of the head, and measuring the area within the traced edge. Head Coverage is the total of the projection areas of each fastener element head, divided by the planar area of the selected area. For the example product shown in this photograph, a Head Coverage of 50% or 0.5 was calculated by this method.

Figure 9:
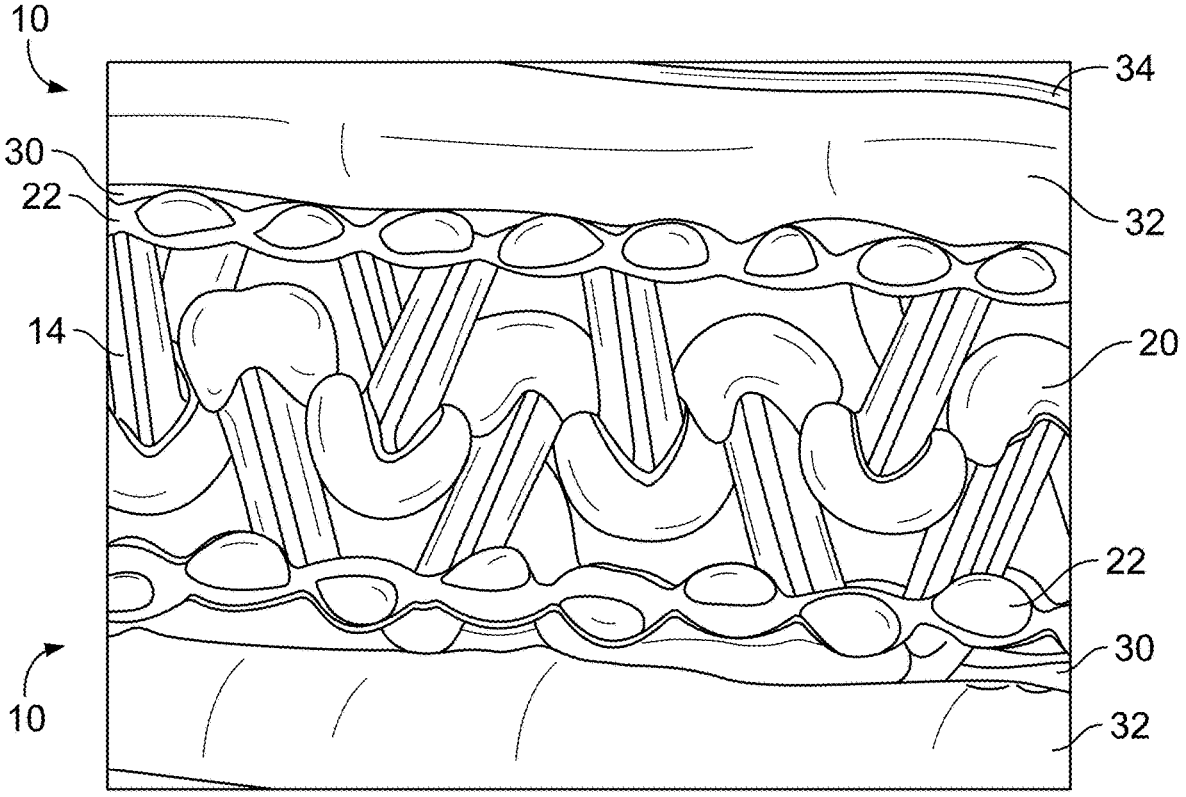
FIG. 9 is an edge photograph of two woven fastener products of FIG. 2 releasably fastened to each other.
Figure 10:
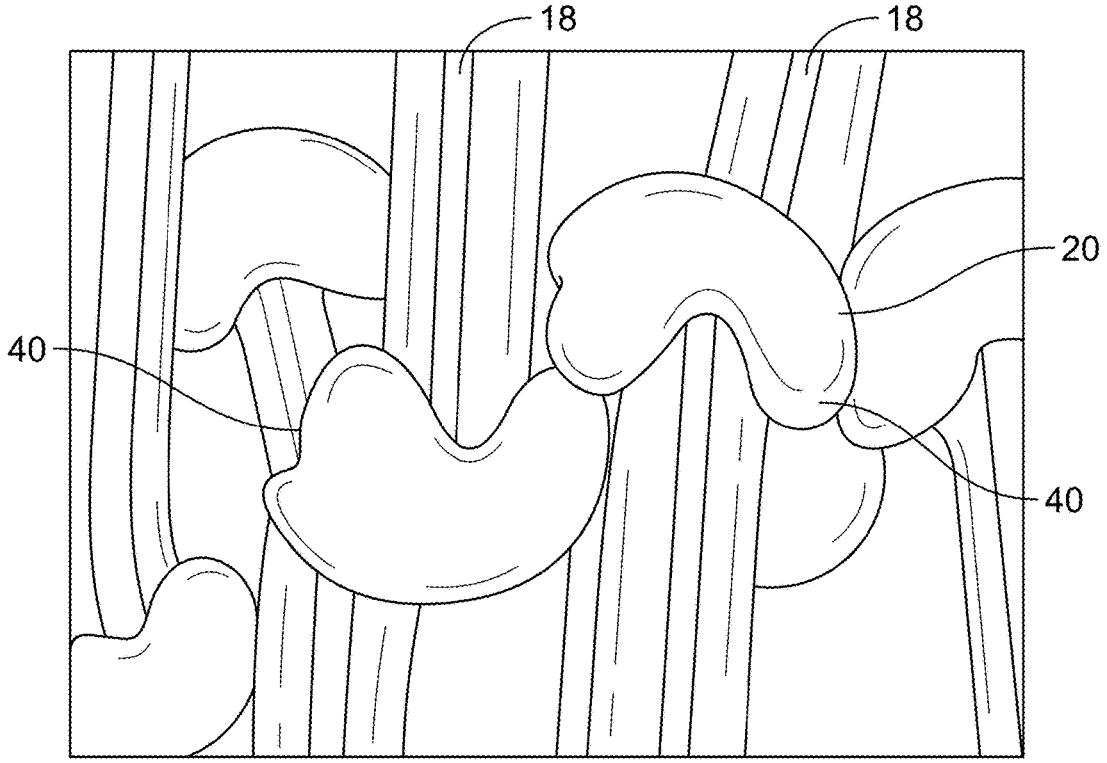
FIG. 10 is an enlarged photograph taken in the warp direction, showing two engaged fastener element heads.

The product described above is useful as a self-engaging fastener, as shown in FIG. 9, in which two identical products 10 are mated to form an engagement that resists separation by peel or lift, or displacement under shear. In this photograph, the products are aligned such that their warp directions both extend across the photograph. The middle two fastener elements 14 of the upper product, for example, are the ends of a single monofilament pile segment, as are the rightmost two fastener elements of the lower product (the outline of the interconnecting filament bend being visible at the lower right of the photograph). As shown in FIGS. 9 and 10, the heads 20 of the fastener elements interlock, with the lobes 40 of the heads engaging one another in many instances, to resist separation. The heads are sized and spaced such that engagement of any given head tends to occur on two opposite sides, with each of two warp-adjacent fastener elements. The domed upper surfaces of the fastener element heads assist in displacing the fastener elements laterally to permit engagement, and the bending flexibility of the stems allows the fastener elements to recover upon engagement so as to maximize the effective overlap of the engaged heads. As a result of the engagement of the lobed undersides of the fastener element heads, a proportionally high lift separation force resistance is achieved.

FIG. 9 also illustrates that the warp monofilaments that make up the fastener elements tend to not be significantly twisted as a result of the weaving, stabilization and head-forming processes. One flange of each monofilament cross-section is directed toward the camera in each of the eight fastener elements shown. This view also shows the binder 30 on the non-fastening side of each fabric ground 22, effectively anchoring the monofilaments and stabilizing the ground weave, and the foam PSA 32 permanently bonded to the binder.

Two engaged, identical strips of the self-engaging fastener product shown in FIGS. 9 and 10 exhibited peel and shear resistance of 2.0 N/cm and 51 $N/cm^2$, respectively, when tested according to ASTM D 5170-98 and D 5169-98. We note that the peel and shear results of the tested samples were influenced by the stiffness of the finished products themselves, and that the peel and shear performance may have been different for a more flexible product. Moreover, the engaged strips demonstrated a Self-Engaged Lift Resistance (SELR) of 44 $N/cm^2$ when tested in accordance with the lift resistance test method described below, with a peak engagement load of only 19 $N/cm^2$ required to interlock the fastener elements.

Figure 10A:
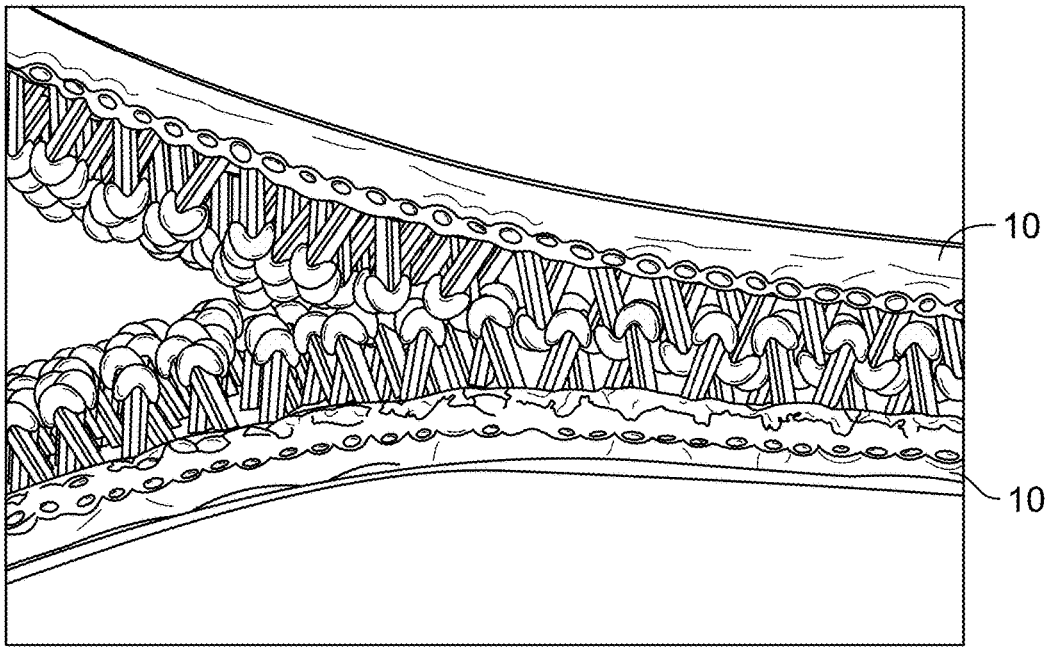
FIG. 10A shows two mated fastener products being released in a peeling mode.

As shown in FIG. 10A, in a peel mode the bases of the fastener products flex or bend, opening up the spacing between fastener element heads near the point of disengagement, providing a significantly lower resistance to disengagement than in a lift mode in which the two fastener products remain generally planar and parallel during separation. In peel, discrete engagements between interlocked fastener element head lobes separate progressively.

Figure 11:
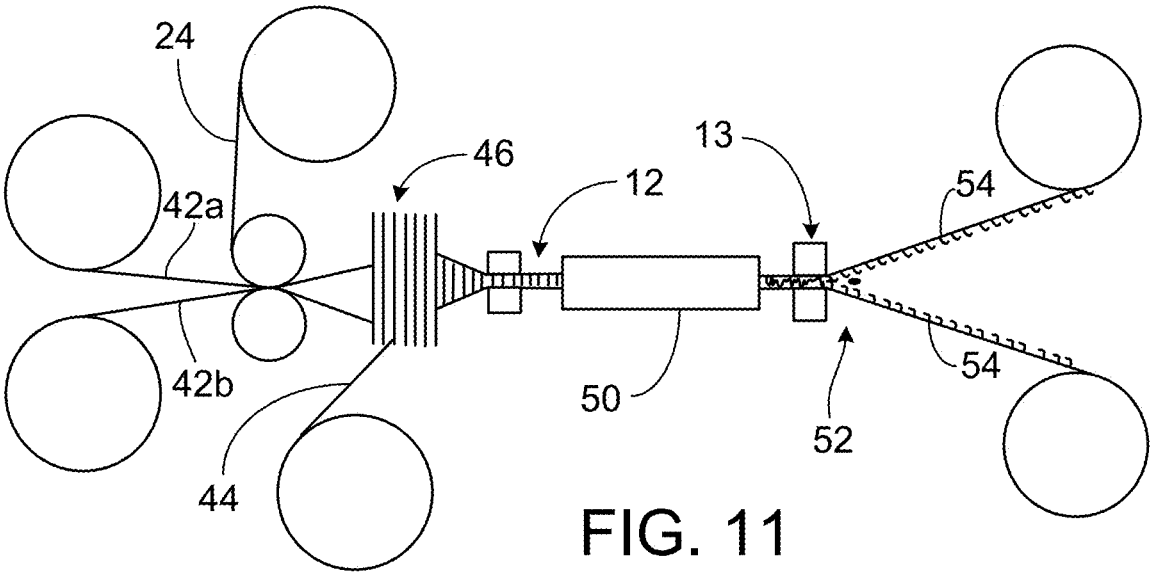
FIG. 11 is a schematic illustration of a machine and method for making woven fastener products.
Figure 12:
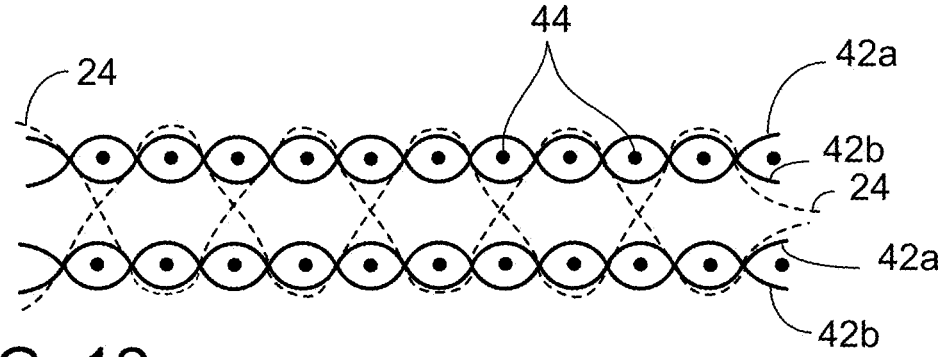
FIG. 12 is an enlarged view of area 12 in FIG. 11 and illustrates the structure of the double woven tape.

Referring now to FIG. 11, a process of making the products discussed herein involves unwinding warp ground yarns 42*a*, 42*b* and pile monofilament 24 into a horizontal loom 46 where such yarns and filaments are woven with weft yarns 44 to form a double tape 48 interconnected by pile (as shown schematically in FIG. 12). To make the tape described above, the pile monofilament 24 was held at a tension of about 135 cN, and the warp ground yarns were held at a tension of about 100 cN. Immediately after weaving, the double tape passes through a fixation oven 50, where the bends in the monofilament pile fibers are partially annealed. From there, the double tape passes to a separation station 52 where the upper and lower tapes are separated by severing the interconnecting pile filaments. The upper and lower tapes are then separately spooled for later processing.

The fixation oven 50 includes heated plates above and below the double tape, which passes through the oven continuously. The arrangement of plates above and below the tape means that the back (non-pile) sides of the tapes are exposed to radiant heating by the plates, thereby selectively annealing the bends of the pile fibers on the back side of each tape. The speed of the tape and the length of the oven are selected to provide the desired heat exposure time to effect the appropriate amount of annealing. For the example described above, the heated plates are 10 cm long and the double tape moves through the fixation oven at a speed of 24 cm/min, resulting in a heating time of about 30 seconds. We have found that for the particular polypropylene monofilament fiber used in this example, woven into the ground as shown, a fixation oven temperature of 135 C, as measured at the surface of the heating plates, provided the desired amount of annealing to produce the amount of stem inclination needed to result in the hexagonal head configuration after pile severing. Holding all other parameters constant, a hotter or longer annealing process would result in more upright stems, while less annealing would result in more inclined stems. An only partial anneal also helps to preserve some tenacity in the pile fibers.

Referring to FIG. 12, in this example the warp yarns 42*a*, 42*b* of each of the upper and lower tapes include 268 threads of 167/1 PES ecru for a 75 mm wide double tape, and the weft yarns 44 of each tape include 237 threads of 0.17 PES monofilament black, paired as twin yarns. As noted above, the pile is formed of a shaped polypropylene monofilament. For a 75 mm wide tape, 54 pile threads were included. The weaving was done with 11.6 picks/cm, and results in a double tape having an overall thickness of about 10 mm.

Figure 13:
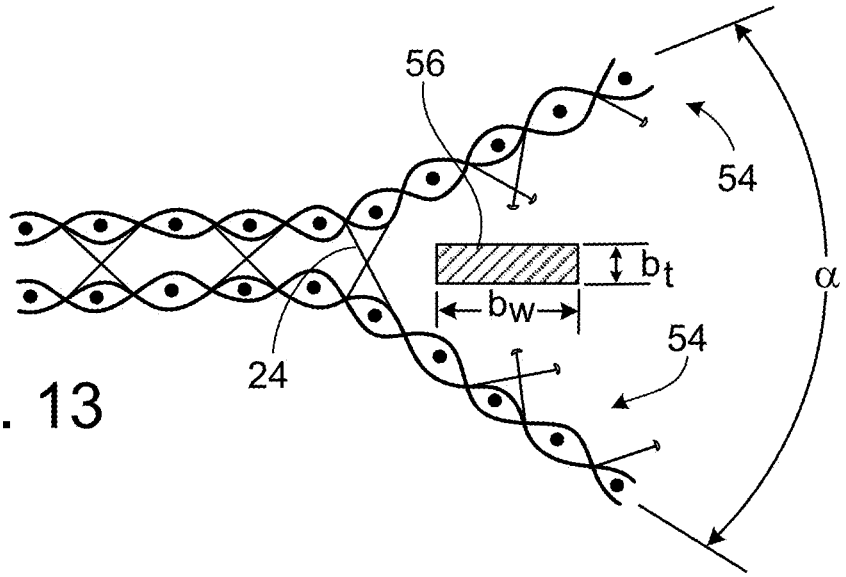
FIG. 13 is an enlarged view of area 13 in FIG. 11 and illustrates separating the double tape and forming heads on the exposed pile thread ends.

Referring to FIG. 13, the monofilament fibers 44 interconnecting the upper and lower tapes 54 are severed by a hot NiCr blade 56 extending across the machine. The blade is held at a fixed surface temperature of about 220-240 C, which at the speed of the tape and the tension applied to the pile filaments by the physical separation of the tapes, is sufficient to sever the fibers without physical contact, keeping the blade free of polymer residue. Rather, the polymer of the middle portion of each pile fiber melts as the pile approaches the blade, severing the fibers while under tension. Immediately following severing, the now exposed pile fiber ends are exposed to heat from the side surfaces of the blade as the polymer at the fiber ends continues to melt and draw back to form the heads as shown in the above example. Separating the tapes at an included separation angle $\alpha$ of 64 degrees, we have found that using a rectangular blade of thickness bt of 0.1 mm and a width bw of 5-6 mm results in the necessary flow characteristics to produce lobed, domed fastener element heads. The temperature of the blade should be maintained as consistent as possible across the tapes, to produce a consistent fastener element height. Following separation, each 75 mm tape is longitudinally split along two 2 mm wide fastener-free lanes to form three separate fastener tapes of 25 mm width, each having 1 mm selvedges.

Figure 14:
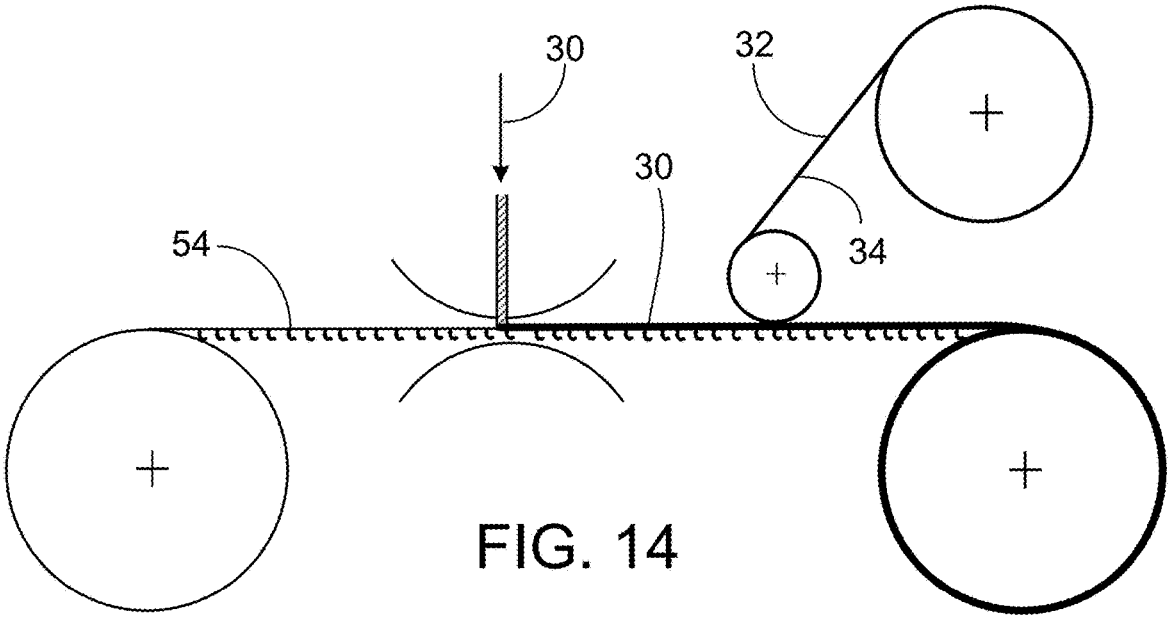
FIG. 14 is a schematic illustration of a process of coating and binding the woven tape and applying a backing.

Referring next to FIG. 14, later processing of the woven tape 54 includes coating the non-fastening side of the tape with a polyurethane bot melt binder 30 and then, while the polyurethane remains tacky or molten, applying an acrylic foam backing 32 with a release liner 34 over a PSA. The running speed of this processing sequence may be significantly faster than that of the weaving, such as 10 m/min, with the backing being applied about 15 cm downstream of the application of the polyurethane. The polyurethane coating is applied at a coverage of 300 gsm and a temperature of 120 C through a slot against the back side of the tape, but without significant pressure. The viscosity of the coating is such that some penetration into the weave occurs by wicking before the polyurethane completely sets, binding fibers of the fabric ground to each other and to the pile fibers, but not so much as to be visible at the fastening surface of the final product. A suitable coating is SikaMelt-9670 LV, available from Sika Automotive GmbH. The acrylic foam backing provides some compliance perpendicular to the fastener tape, and can help reduce vibration and noise transmission through the fastening, for example. Other back surface configurations are envisioned, such as using an industrial polyurethane hot melt sufficient to later adhere the final product to a supporting surface.

Figure 15:
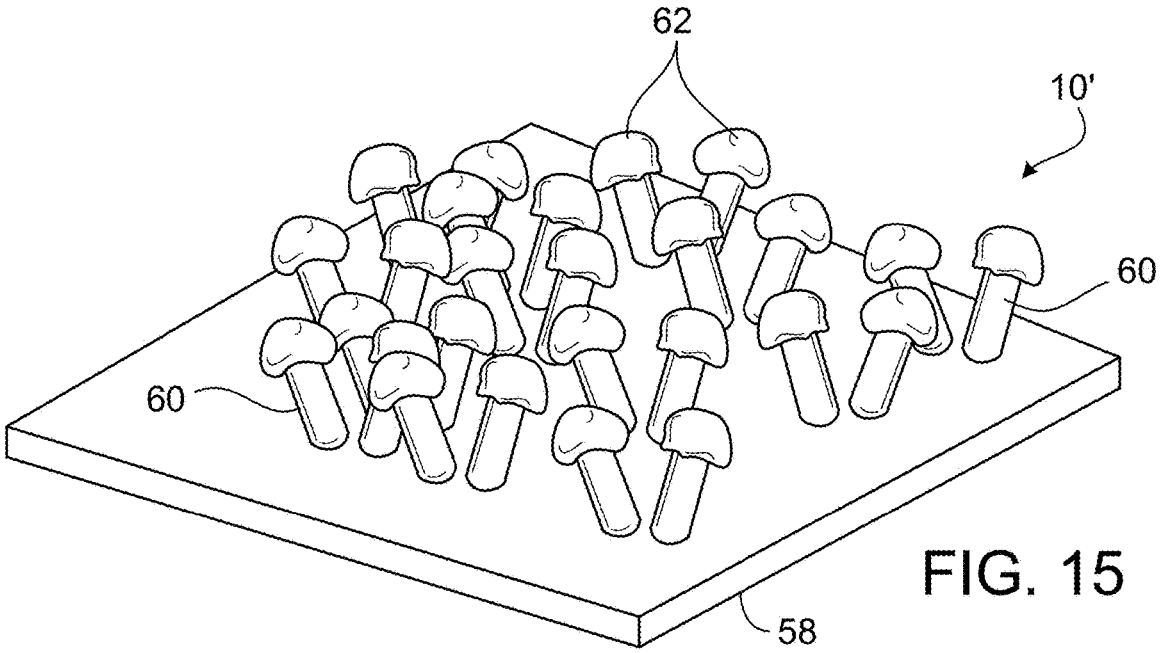
FIG. 15 is a perspective view of a molded fastener product.
Figure 16:
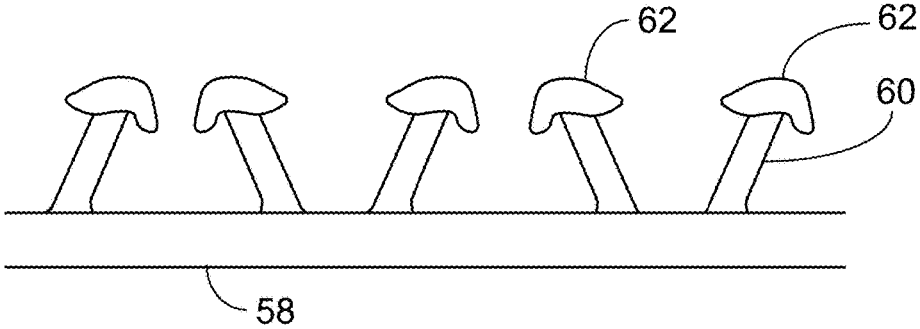
FIG. 16 is an edge view of the molded fastener product of FIG. 15.

A similar hexagonal or honeycomb arrangement of mushroom-type fastener element heads can be provided in fastener products of other structures. For example, FIGS. 15 and 16 show a fastener product 10' having a sheet-form molded base 58 from which molded stems 60 extend in an array, such that heads 62 at the end of the stems form similar hexagonal groupings as those discussed above. The stems and base together form a single, contiguous mass of a resin, and can be formed by suitable roll-molding methods such as those taught in U.S. Pat. Nos. 4,775,310, 5,845,375 and 5,781,969. The heads can subsequently be formed by melting and flowing resin at the distal ends of the stems, such as by heat or a combination of heat and pressure applied to the stem ends. For example, the ends may be flattened by a heated roller, or by a chilled roller after localized heating, as taught in U.S. Pat. No. 6,248,276, or molded into a desired head shape by an indexed head-forming roller, as taught in U.S. Pat. No. 6,991,843 (the entire contents of which are incorporated herein by reference.

Self-Engaged Lift Resistance (SELR)

To measure the SELR of a self-engaging fastener product, the following test method is used. First, the product to be tested is pre-conditioned for 24 hours in an atmosphere of 20° C. (+/−2° C.) and 65% (+/−2%) relative humidity. The product is then cut into lengths of 5 cm and two lengths are completely overlapped and pressed to engage over the entire overlapped area. Unless otherwise specified, the two samples are arranged such that the same longitudinal direction of the original product is directed toward the same end of the overlapped lengths (i.e., a relative orientation angle of) 0°. The exposed non-fastening surfaces of the engaged product lengths are adhered to opposing surfaces (jaws) of a tensile test machine. For example, if the product has an adhesive backing the backing adhesive can be used to adhere the engaged product to the opposed surfaces. The engaged strips are compressed slowly to a pressure of 80 N per cm of engaged width, to be sure of complete engagement, and held for 15 minutes to be sure of the bonding of the back surfaces to the jaws. The jaws are then separated 10 mm while monitoring load, separating the fasteners, and the peak load to cause separation is recorded. This procedure is performed for five distinct samples, and the values averaged. For the product shown in the photographs, the measured SELR was 44 N/cm$^2$.

Similarly, to measure engagement resistance, or the force required to engage the two parallel fastener strips, the jaws are brought slowly together until reengagement occurs, and the peak load to cause engagement is recorded. The procedure is performed for five distinct samples, and the values averaged. For the product shown in the photographs, the measured engagement resistance was 19 N/cm$^2$. Thus, the SELR was more than twice the engagement resistance. Note that engagement resistance can be measured immediately after measuring SELR, by reversing the direction of the tensile machine and bringing the separated products back into engagement.

For the SELR and engagement resistance of the product shown in the photographs, the measured values had a standard deviation between samples of about 7 N/cm$^2$.

A similar measurement can be obtained with different overlap configurations. For example, lift resistance can be measured with the samples overlapping at 90° (i.e., the longitudinal direction of one engaged strip running perpendicular to the longitudinal direction of the other strip) or 180° (i.e., the common longitudinal direction of the strips running in opposite directions). The two strips can alternatively be overlapped at a different relative angle, such as 45° (i.e., the common longitudinal direction of the strips bounding a 45° relative orientation angle), to determine the lift resistance of fastenings made at different relative orientations. For sample orientations of other than 0° and 180°, strips of extended length are overlapped and engaged at the desired relative orientation angle and then both strips are trimmed to leave only the overlapped area for testing. For the product shown in the photographs, the lift resistance at angles of 45°, 90° and 180° was 47, 33 and 43 N/cm$^2$, respectively, and the engagement resistance at those orientations was 14, 13 and 18 N/cm$^2$, respectively. Unless otherwise specified, our references to SELR and engagement resistance are at a relative orientation angle of 0°.

While a number of examples have been described for illustration purposes, the foregoing description is not intended to limit the scope of the invention, which is defined by the scope of the appended claims. There are and will be other examples and modifications within the scope of the following claims.

What is claimed is:

1. A fastener comprising:

a flexible base sheet; and an array of discrete fastener elements projecting from a broad side of the base sheet, each fastener element comprising a stem extending from the base sheet and a head at a distal end of the stem, the head overhanging the base sheet on multiple sides of the stem and spaced from all adjacent fastener element heads;

wherein the heads of the discrete fastener elements are arranged in a pattern of hexagonal groupings of fastener element heads bordering central regions void of fastener element heads, with each fastener element head spaced from edges of the array being part of three adjacent groupings.

2. The fastener of claim 1, wherein the stems of the fastener elements have a non-circular cross-section.

3. The fastener of claim 1, wherein each head has multiple lobes extending in different directions.

4. The fastener of claim 3, wherein the lobes extend toward the broad side of the base sheet to define, with an underside of the fastener element head, a crook.

5. The fastener of claim 3, wherein each head has four lobes.

6. The fastener of claim 1, wherein each grouping consists of six fastener element heads.

7. The fastener of claim 1, having a Head Coverage of between 30 and 60 percent.

8. The fastener of claim 1, wherein the stems of the fastener elements are canted in different directions.

9. The fastener of claim 1, wherein the stems are molded integrally with the broad side of the base sheet.

10. The fastener of claim 1, wherein the base sheet comprises a woven base and the stems of the fastener elements are extensions of fibers woven into the base.

11. The fastener of claim 10, wherein the stems are extensions of monofilament fibers.

12. The fastener of claim 11, wherein the monofilament fibers comprise warp fibers of the woven base.

13. The fastener of claim 11, wherein the monofilament fibers are drawn monofilament fibers of non-circular cross-section.

14. The fastener of claim 10, wherein the stems are arranged in pairs, with each pair consisting of two ends of a single, continuous fiber woven into the base.

15. The fastener of claim 14, wherein the single, continuous fiber extends about only a single set of one or more fibers woven as a set through the woven base.

16. The fastener of claim 10, further comprising a coating covering a side of the woven base opposite the fastener elements and binding fibers of the woven base.

17. The fastener of claim 2, wherein the stems of the fastener elements each have four equally spaced longitudinal flanges extending from a central hub.

18. The fastener of claim 17, wherein each flange has a thickness of about 0.1 millimeter.

19. The fastener of claim 8, wherein each stem is inclined at between about 14 and 20 degrees with respect to a direction normal to the base sheet.

* * * * *